United States Patent [19]

Scholtes et al.

[11] 4,206,804

[45] Jun. 10, 1980

[54] HEATED AIR CIRCULATOR

[76] Inventors: Edward L. Scholtes; Herbert N. Van Cleave, both of Pendelton, Oreg. 97801

[21] Appl. No.: 931,557

[22] Filed: Aug. 7, 1978

[51] Int. Cl.[2] ..... F28F 7/00

[52] U.S. Cl. ..... 165/40; 165/76; 165/DIG. 2; 236/93 R; 126/61; 126/67

[58] Field of Search ..... 126/61, 63, 67, 66, 126/110 A, 110 R, 110 D, 6, 68, 69, 77; 165/DIG. 3, 76, 40; 236/93 R; 113/116 R, 116 F, 116 G; 29/407

[56] References Cited

U.S. PATENT DOCUMENTS

| | | | |
|---|---|---|---|
| 355,208 | 12/1886 | Rew | 126/6 |
| 907,292 | 12/1908 | Sanders | 126/67 |
| 1,213,212 | 1/1917 | Knaack et al. | 126/67 |
| 1,334,827 | 3/1920 | Yost | 126/6 |
| 4,015,579 | 4/1977 | Wirth et al. | 126/63 |
| 4,111,182 | 9/1978 | Roberts et al. | 126/110 B |

*Primary Examiner*—Albert W. Davis
*Assistant Examiner*—Margaret A. Focarino
*Attorney, Agent, or Firm*—Kolisch, Hartwell & Dickinson

[57] ABSTRACT

A heated air circulator adapted to be placed against a radiant-type heating stove. The housing of the circulator, which defines a chamber therewithin, includes upright back and side walls which are unjoined along their adjacent upper edge portions. A plurality of spaced-apart, transverse fold lines on the back and side walls, where the same are unjoined, permit portions of these walls to be folded over to form a chamber top at a height conforming to the height of the stove. The circulator includes a damper regulated by a temperature-responsive spring whereby flow of unheated air into the chamber increases as the temperature within the chamber increases.

7 Claims, 5 Drawing Figures

HEATED AIR CIRCULATOR

BACKGROUND AND SUMMARY

The present invention relates to heated air circulators, and in particular, to a circulator adapted to be placed against a radiant-type heating stove, with the height of the circulator conforming to the height of the stove.

Air circulators adapted to receive heat from a radiant-type heating stove and distribute heated air are known. Such circulators are generally dimensioned to fit stoves of specific sizes. Thus, different-sized circulators are required for different sizes of heating stoves.

Circulators known in the prior art typically provide a manually-controlled damper for admitting unheated air thereinto. By correct adjustment of such damper, the temperature of heated air issuing from the circulator can be maintained relatively constant. However, this requires periodic damper adjustment on the part of the user. Furthermore, the flow regulation so achieved may not provide optimal heating efficiency.

It is, therefore, an important object of the present invention to provide an air circulator which is adaptable for use with radiant-type heating stoves of different sizes.

It is another object of the invention to provide an air circulator which is free-standing, and can be placed against a side of a heating stove in heat-conducting relationship therewith.

It is yet another object of the invention to provide an air circulator in which the flow of unheated air into a circulator chamber is regulated by a temperature-controlled damper.

The present invention is a heated air circulator adapted to be placed adjacent one wall of a radiant-type heating stove. The housing of the circulator, which defines a heating chamber therein, includes an upright back wall, opposed upright side walls, and a bottom joining the lower edges of these walls. The back and side walls are unjoined along their upper edge portions. A plurality of spaced-apart, transverse fold lines on the back and side walls, where the same are unjoined, permit portions of these walls to be broken off and folded over to form a chamber top at a height conforming to the height of the stove against which the circulator is to be placed.

The circulator has an intake opening in the back wall and a damper plate mounted adjacent this opening for movement between open and closed positions wherein flow of air through the opening is permitted and restricted, respectively. Movement of the plate is controlled by a temperature-responsive spring located within the chamber and interconnecting the plate and the circulator back wall.

Other objects and features of the present invention will become more fully apparent with reference to the following detailed description of the invention, and the accompanying drawings.

DRAWINGS

DETAILED DESCRIPTION OF A PREFERRED EMBODIMENT OF THE INVENTION

Figure 1:
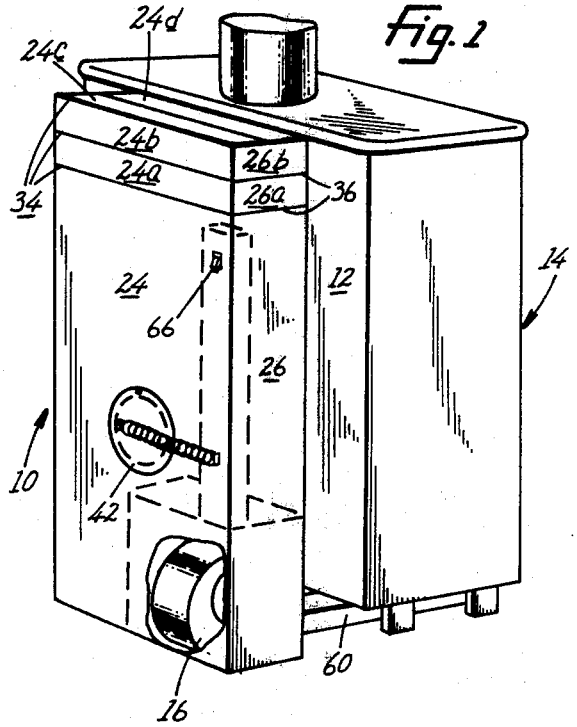
FIG. 1 is a rear perspective view of a radiant-type heating stove, having an air circulator constructed according to the present invention, mounted adjacent its back surface.

Referring first to FIG. 1, there is indicated generally at 10 a heated air circulator constructed according to a preferred embodiment of the invention. Circulator 10 is a free-standing unit adapted to be placed against the back wall 12 of a radiant-type heating stove 14. Heat radiating from the stove is used to warm air within the circulator, and this heated air, which is maintained within a desired temperature range, is exhausted by means of a motor-driven fan 16 located in the bottom portion of the circulator.

Figure 2:
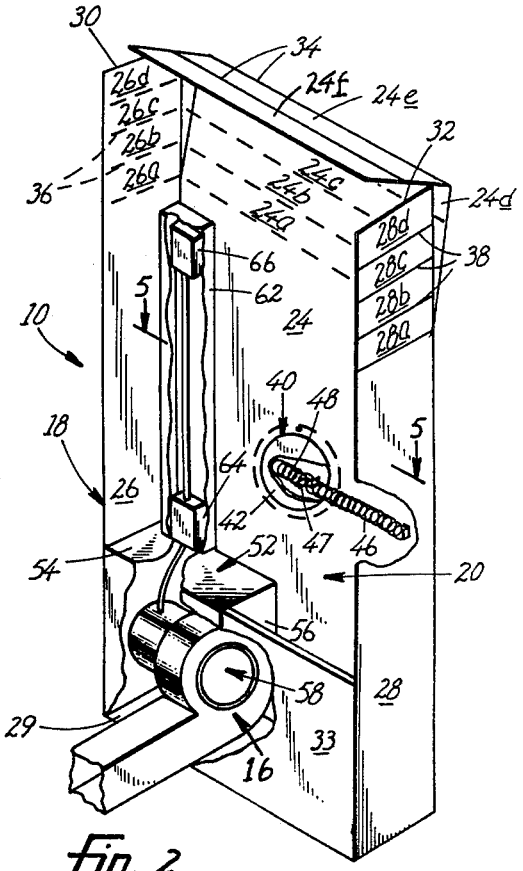
FIG. 2 is a front perspective view, of the air circulator of the present invention, with portions cut away.

Referring now to FIG. 2, circulator 10 generally comprises a housing 18 defining a chamber 20 therein. Housing 18 includes an upright back wall 24, opposed upright side walls 26, 28 and a bottom wall 29 joining the lower edges of the back and side walls. Prior to shaping, back wall 24 extends beyond the upper edges 30, 32 of sidewalls 26, 28, respectively, a distance equal to the width of the sidewalls. Walls 26, 28, which are joined to wall 24 along a major portion of their adjacent edges, are unjoined thereto along upper edge portions of the walls, for a purpose to be explained below.

Housing 18 further includes a front wall 33 extending between lower edge portions of opposed walls 26, 28, and connected along its bottom edge to bottom wall 29. The above-described housing may be constructed from a single piece of sheet metal having a central section forming back, bottom, and front walls 24, 29, 33, respectively, and opposed sides margins which are folded inwardly therefrom to form side walls 26, 28. The sheet metal is suitably cut along upper portions between the central section forming wall 24 and the side margins forming opposed side walls 26, 28. Bottom and front walls 29, 33 are conventionally joined, for instance by welding, to the adjacent edge portions of the side walls 26, 28.

Defined on walls 24, 26, 28, where the same are unjoined along their upper edge portions, are a plurality of spaced-apart, transverse score, or fold lines, such as lines 34 on wall 24, lines 36 on wall 26, and lines 38 on wall 28. Lines 34, 36, 38, may be thought of as partitioning the upper portions of walls 24, 26, 28, respectively, into rectangular segments, noted here as segments **24*a*–24*f*, 26*a*–26*d*, 28*a*–28*d*, respectively. Score lines 34, 36, 38 are prefold indentations along which upper portions of walls 24, 26, 28, respectively, can be bent over or broken away. This may be appreciated with reference to FIG. 2, where the upper portion of wall 24 is shown bent along fold line 34 between wall segments 24*d*, 24*e***. By continued bending along such score line, the metal forming the indentation is weakened by metal fatigue, allowing the segment(s) above the line to be broken away.

Figure 4:
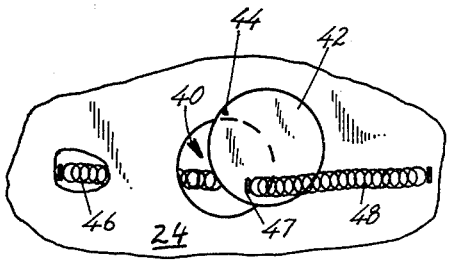
FIG. 4 is an enlarged, fragmentary portion of the back wall of the circulator, seen from the exterior, with a portion cut away to show the heat-responsive spring controlling motion of the damper.
Figure 5:
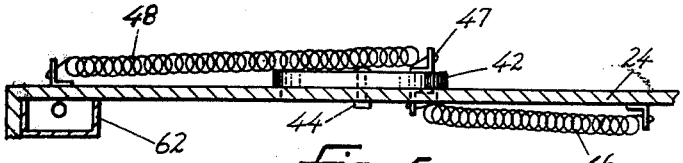
FIG. 5 is an enlarged sectional view taken generally along line 5—5 in FIG. 2.

Defined in back wall 24 is a circular intake opening 40 through which unheated air may be admitted into chamber 20 during operation of the circulator (FIGS. 2, 4, and 5). A circular damper plate 42 is pivotally attached to the outwardly-facing side of wall 24 at 44 for swinging movement toward and away from a closed position, wherein the damper plate covers opening 40, being substantially concentric therewith as illustrated in FIGS. 1 and 2. The damper plate may be swung away to open positions, such as the open position shown in FIG. 4, wherein a portion of opening 40 is uncovered, permitting flow of air therethrough.

The position of the damper is controlled by temperature-responsive means operatively connected to the plate for moving the same between open and closed positions as the temperature within the chamber increases and decreases, respectively. As best seen in FIGS. 4 and 5, the temperature-responsive means includes a spring 46 connected at one end to the inwardly-facing side of wall 24, and at its other end to the inwardly-facing side of plate 42, being connected thereto through a plate-mounted pin 47. Spring 46 is a tension spring having temperature-dependent characteristics, such that the tension exerted by the spring decreases as the temperature of the spring increases.

A second tension spring 48 is connected at one end to the outwardly-facing side of wall 24, and at its other end to pin 47 on the outwardly-facing side of plate 42. Spring 48 provides a counterforce to spring 46, whereby plate 42 is held in its closed position, when spring 46 is at ambient temperatures. As the temperature of spring 46 is increased, and the tension exerted by this spring decreases, spring 48 is effective to move plate 42 toward an open position, with the extent of movement increasing as the temperature within chamber 20 increases.

Referring to FIG. 2, motor-driven fan 16 is housed in a fan chamber 52 formed by portions of front and back walls 33, 24, respectively and a pair of orthogonal plates 54, 56, joining the front and back walls. Plate 56 is provided with an opening (not shown) coincident with the fan's intake 58, through which opening heated air is drawn from chamber 20 into the fan. Heated air is discharged from the fan through a horizontally-disposed fan outlet 60 which passes through an opening (not shown) in front wall 33, and extends under stove 14, as indicated in FIG. 1.

Contained within an elongate housing 62 extending upwardly from housing 52 are a conventional thermostat 64 and a fan switch 66, the latter being accessible from the exterior of the circulator, as shown in FIG. 1. Switch 66 electrically connects fan 16 to an electric power cord. Thermostat 64 in the fan-switch circuit serves to close such circuit above a desired temperature.

The operation of the above-described circulator, in relation to a conventional radiant-type heating stove, such as stove 14, will now be described. Circulator 10 is designed to be placed against stove 14 in a free standing fashion, with the open face of chamber 20 being adjacent the rear wall 12 of the stove, and the height of the circulator being equal to, or somewhat less than, the stove height. As seen in FIG. 2, the height of the circulator 10 is defined by the distance between bottom wall 29 and upper edges 30, 32, of walls 26, 28, respectively. To adapt the circulator to conform to the height of stove 14, the uppermost segments of walls 24, 26, 28 are bent downwardly along coplanar score lines 34, 36, 38, respectively, at such height.

Figure 3:
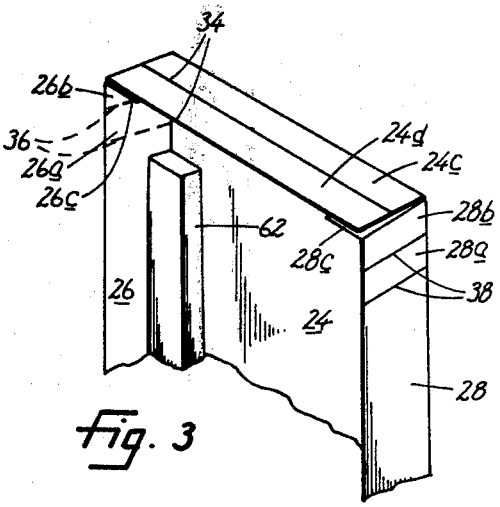
FIG. 3 is a fragmentary, perspective view of the upper front portion of the circulator of FIG. 2, showing portions of the top and sidewalls broken away and folded over to form a chamber top.

A preferable manner of adapting the circulator to the height of the stove is indicated in FIG. 3. Here, upper segments 26*d*, 28*d*, of walls 26, 28, respectively, and upper segments 24*e*, 24*f*, of walls 24, are broken away from the respective walls, as described above. Following this, segments 26*c*, 28*c*, of walls 26, 28, respectively, and segments 24*c*, 24*d*, of wall 24 are folded inwardly along the appropriate coplanar score lines. Segments 24*c*, 24*d*, which have a width equal to the width of walls 26, 28, now overlap segments 26*c*, 28*c*, to form the top of the chamber, with the height of the chamber being somewhat less than that of the stove.

In operation, heat from stove 14 radiates through the back wall 12, heating the air within chamber 20. Initially, this air is relatively cool, so that damper plate 42 is in its closed position, and the thermostatically-controlled fan is off. When air within the chamber is heated to a thermostat-switching temperature, fan 16 is switched on, thus to circulate air from the chamber out into the room. As the air within the chamber continues to heat up, temperature-responsive spring 46 expands, and/or manifests a decreased spring constant, whereby countertension of spring 48 moves plate 42 toward an open position. As this occurs, unheated air is drawn into the chamber through opening 40, mixing with, and cooling the heated air, within the chamber. Upon such cooling occurring, temperature-responsive spring 46 exerts a greater countertension on spring 48, moving plate 42 toward a closed position. There is thus established position of plate 42 at which the inflow of unheated air through opening 40 balances the heat gained from the stove. At this position, the heated air within the chamber is maintained at an essentially constant temperature.

There has been disclosed above an air circulator designed to be placed against the back of a radiant-type heating stove, with the height of the circulator being adjustable to conform to the height of the stove, and the temperature of heated air issuing from the circulator being self-regulated. Various modifications may be made in the above-described invention without departing from the spirit thereof.

It is claimed and desired to secure by Letters Patent:

1. A heated air circulator adapted to be placed adjacent a radiant-type heating stove, comprising a housing including wall means defining a chamber therein, said wall means comprising an upright back wall and opposed upright side walls, said back and side walls being unjoined along their adjacent upper edge portions, p1 means defining a plurality of spaced-apart, transverse fold lines on said back and side walls, permitting portion of said walls, where the same are unjoined, to be folded over to form a chamber top at a height conforming to the height of said stove, and flow means for controlling the flow of air through said chamber.

2. The circulator of claim 1 wherein said wall means comprises a sheet of metal having a central section forming said back wall, and opposed side margins folded inwardly therefrom, forming said side walls, with upper portions of said central section and said side margins being unjoined along their adjacent edges.

3. The circulator of claim 1 wherein said flow means includes an intake opening defined in said wall means, a damper plate mounted on said wall means adjacent said opening for movement between open and closed positions wherein said plate controls flow of air through said opening, and temperature-responsive means operatively connected to said plate for moving the plate between open and closed positions in response to temperature variations within said chamber.

4. The circulator of claim 3 wherein said damper plate is pivotally mounted on said wall means and said temperature-responsive means includes a spring mounted in said chamber and having temperature-dependent characteristics.

5. The circulator of claim 4 wherein said spring is a tension spring biasing said plate toward its closed position, and said temperature-responsive means further includes a second tension spring mounted outside said chamber, operatively connected to said plate, yieldably biasing the plate toward an open position.

6. The circulator of claim 3 wherein said flow means further comprises an exhaust opening defined in said wall means and a motor-driven fan for discharging air from said chamber through said exhaust opening.

7. A heated air circulator adapted to be placed adjacent a radiant-type heating stove, comprising a housing including wall means defining a chamber therein, said wall means comprising a sheet of metal having a central section forming a back wall and opposed side margins folded inwardly therefrom to form a pair of opposed upright side walls, with upper portions of said central section and said side margins being unjoined along their adjacent edges, means defining a plurality of spaced-apart, transverse fold lines on said back and side walls, permitting portions of said walls, where the same are unjoined, to be folded over to form a chamber top at a height conforming to the height of said stove, intake and exhaust openings defined in said wall means, permitting flow of air through said chamber, a damper plate mounted on said wall means adjacent said intake opening for movement between open and closed positions, wherein said plate controls flow of air through said intake opening, temperature-responsive means for moving said plate toward its open and closed positions in response to temperature variations within chamber, said temperature-responsive means including a temperature-responsive spring mounted within said chamber and connected to said plate to bias said plate toward its closed position, and a second spring mounted outside said chamber and attached to said plate to bias said plate toward an open position, and a motor-driven fan for forcing heated air from said chamber through said exhaust opening.

* * * * *